US005381310A

United States Patent [19]

Brotz

[11] Patent Number: 5,381,310

[45] Date of Patent: Jan. 10, 1995

[54] SHEET-ILLUMINATING SYSTEM

[76] Inventor: Gregory R. Brotz, P.O. Box 1322, Sheboygan, Wis. 53081

[21] Appl. No.: 224,821

[22] Filed: Apr. 8, 1994

Related U.S. Application Data

[63] Continuation-in-part of Ser. No. 892,268, Jun. 2, 1992, which is a continuation-in-part of Ser. No. 765,517, Sep. 25, 1991, Pat. No. 5,118,138.

[51] Int. Cl.[6] ..... F21V 8/00; F21V 9/16; F21V 33/00

[52] U.S. Cl. ..... 362/32; 362/84; 362/98; 362/99

[58] Field of Search ..... 362/32, 34, 97, 98, 362/99, 84

[56] References Cited

U.S. PATENT DOCUMENTS

| | | | |
|---|---|---|---|
| 4,266,164 | 5/1981 | Schroeder | 362/98 |
| 5,016,147 | 5/1991 | Voorhees | 362/99 |
| 5,083,242 | 1/1992 | Piotrowski | 362/97 |
| 5,153,386 | 10/1992 | Siefer et al. | 362/97 |
| 5,163,748 | 11/1992 | Messinger | 362/98 |
| 5,183,323 | 2/1993 | Daniel | 362/32 |
| 5,187,765 | 2/1993 | Muehlemann et al. | 362/32 |
| 5,280,415 | 1/1984 | Barnette | 362/99 |

*Primary Examiner*—Richard R. Cole
*Attorney, Agent, or Firm*—William Nitkin

[57] ABSTRACT

A device and method are disclosed for illuminating an imprinted sheet or an individual page of a book so that it can be read and/or written on under poor light conditions by an individual. The device and method utilize a luminescent sheet disposed under the sheet or page to illuminate the sheet/page from below so that an individual can read the printing on the sheet as well as see his writing on the sheet/page during and after the writing process.

7 Claims, 2 Drawing Sheets

SHEET-ILLUMINATING SYSTEM

This application is a continuation-in-part of my previous application for a Self-illuminating Sheet/Book Page, Ser. No. 07/892,268 filed Jun. 2, 1992, now pending which application is a continuation-in-part of my previous application for a Self-illuminating Book, Ser. No. 07/765,517 filed Sep. 25, 1991, now U.S. Pat. No. 5,118,138.

BACKGROUND OF THE INVENTION

1. Field of the Invention

The device and method of this invention relate to the illumination of a sheet having printed indicia thereon such as on a clipboard or pages of a book and more particularly relate to an electroluminescent sheet or woven fiber-optic fabric which can be disposed under such sheet or book page to be read to provide a light source therethrough for illumination of the printing on such page.

2. Description of the Prior Art

Ambiant light provided by an external light source is the usual method by which a sheet or page of a book is illuminated. Applicant's prior invention relates to providing light from an edge of a transparent sheet to illuminate indicia imprinted on such sheet. Further, the inventor has disclosed sheets having electroluminescent polymer indicia thereon which are activated to produce lighted indicia on such sheets. The inventor has also utilized indicia imprinted on electroluminescent film disposed on a base sheet to make such indicia visible when electrical current is provided to such film.

SUMMARY OF THE INVENTION

It is an object of this invention to provide an illumination device and method. The invention utilizes either a stiffened illuminable sheet of material such as bearing an electroluminescent polymer film which film is well known in the prior art or a woven, fiber-optic filament sheet also known in the prior art. Hereinafter such sheets are referred to as luminescent sheets. In use, the luminescent sheet is placed under an imprinted sheet or page of a book to pass light through such sheet/page when such luminescent sheet is activated such that any printing on the top of the sheet/page becomes visible by action of the light from *the luminescent sheet passing through such page. Such illuminated sheet/page can then be read even in the dark. In an alternate embodiment the luminescent sheet can be disposed in a recess defined in the top surface of a clipboard with the imprinted sheet to be reed positioned thereover such that when a light source is attached to the fiber-optic filament input of a fiber-optic sheet or electrical current is interconnected to an electroluminescent sheet, any printing on the imprinted sheet becomes visible even in the dark from light emanating from the luminescent sheet passing through the imprinted sheet from below. In one embodiment of the invention a battery pack to activate the electroluminescent sheet can be incorporated into such a clipboard or other power means can be associated therewith such as a battery pack clipped onto the cover or spine of the book whose pages are to be read by the method of this invention.

In other embodiments the battery pack can be clipped onto a belt around an individual's waist and connected by flexible electrical leads to the electroluminescent sheet. The electroluminescent sheet can be fitted with a flat, rechargeable battery pack which type of battery is also known in the prior art. When the individual finishes reading a page in the book by the method of this invention, the luminescent sheet can then be placed under the next page desired to be read and so on until the entire book has been read.

The device and method of this invention have the advantage that they can be utilized with existing books or individual imprinted sheets that are printed only on one side without modification or special construction of such books or imprinted sheets. Printing on the rear of a sheet may interfere with clearly reading and or writing over such luminescent sheet.

Also disclosed in this invention is a clipboard for receiving and retaining a sheet which can be blank or have printing thereon, such as a form, for writing and taking notes thereon in poorly lit or dark places. A transparent or translucent piece of paper can be placed over the luminous background of the clipboard or between the pages of a blank notebook. As the user writes, he can see what he is writing and what he has already written because of the luminous background. It should be noted that there can be a rigid sheet of transparent material placed above the luminescent sheet to protect it from wear and to provide a flat writing surface.

The system of this invention allows note-taking in poorly lit places and can be particularly useful in mine shafts or large industrial complexes. At disaster sites where electricity may not be available the system of this invention can be used by the police, insurance company representatives and fire department personnel. The luminescent sheet can be provided in a variety of colors. Pilots and other vehicle operators operating at night can utilize a red luminescent sheet on the device so as not to lose their night vision as would occur after reading or writing under normal lighting conditions. When a luminescent sheet producing red light is used, the device and method of this invention can be utilized in a photographic darkroom where reading and writing are often necessary but where normal white light cannot be used.

DESCRIPTION OF THE PREFERRED EMBODIMENT(S)

Figure 1:
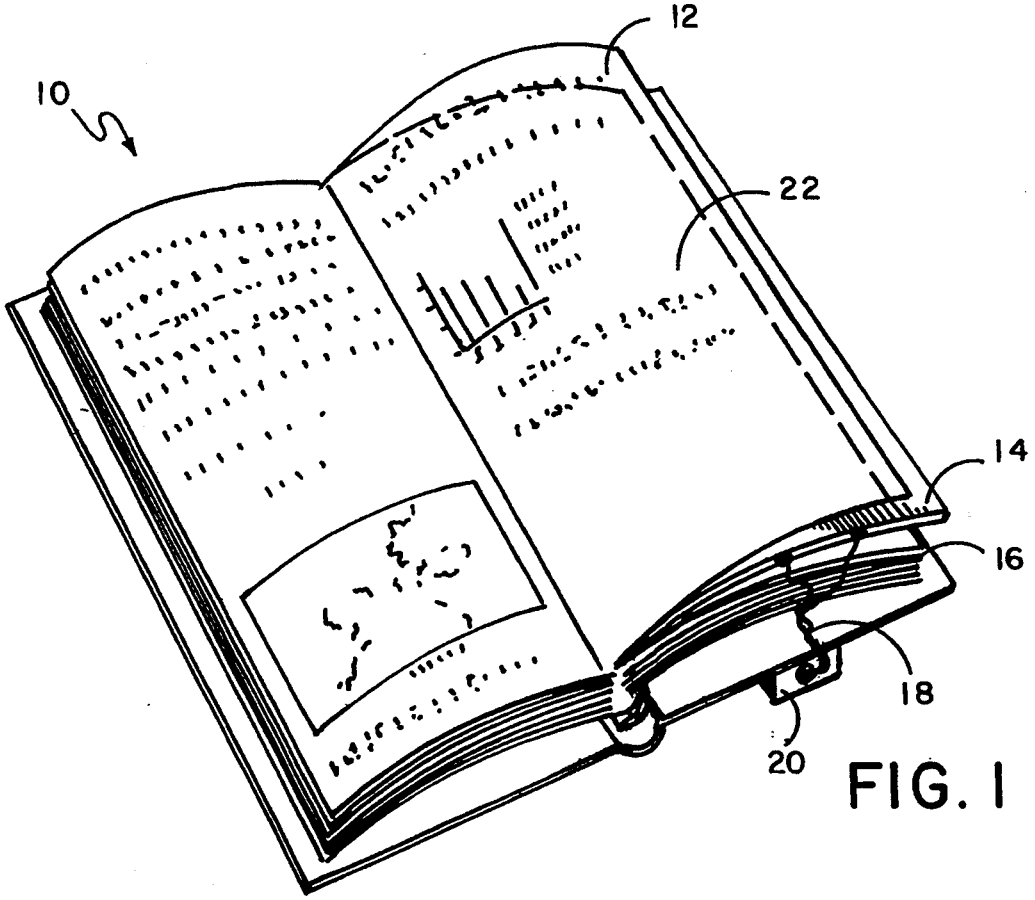
FIG. 1 illustrates a perspective view of a luminescent sheet disposed under an imprinted page of a book to be read.
Figure 3:
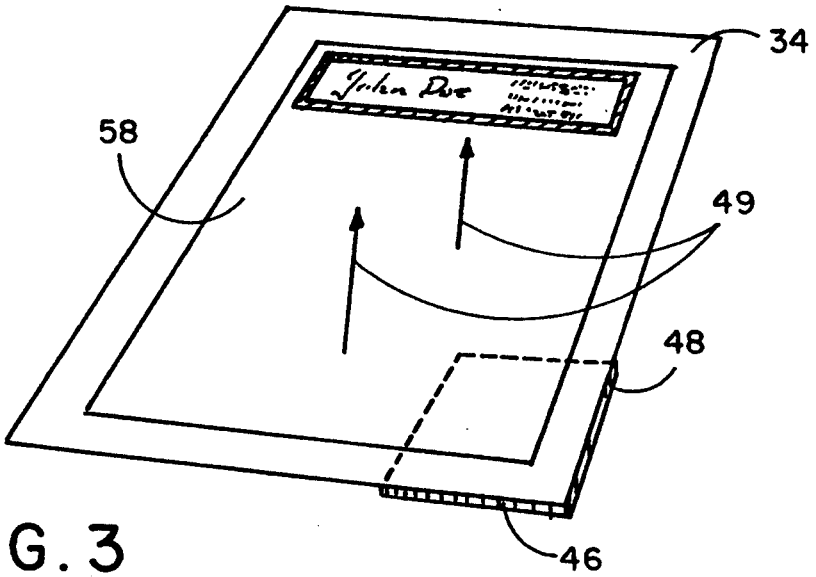
FIG. 3 illustrates a perspective view of a flat battery pack positioned under the luminescent sheet.
Figure 4:
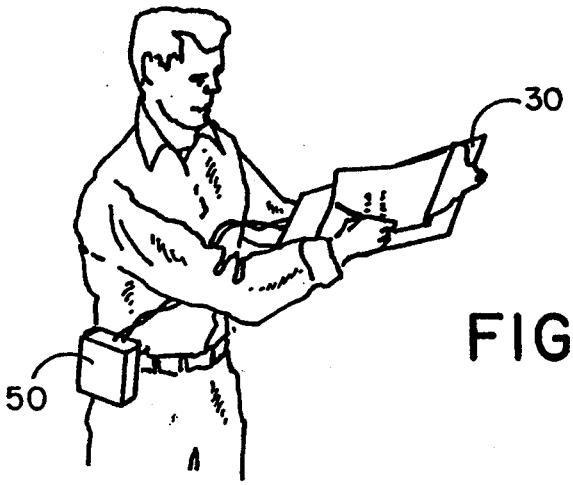
FIG. 4 illustrates a perspective view of a user writing on a clipboard illuminated by the system of this invention with a battery pack on his waist with electrical leads running to the luminescent sheet on the clipboard.
Figure 5:
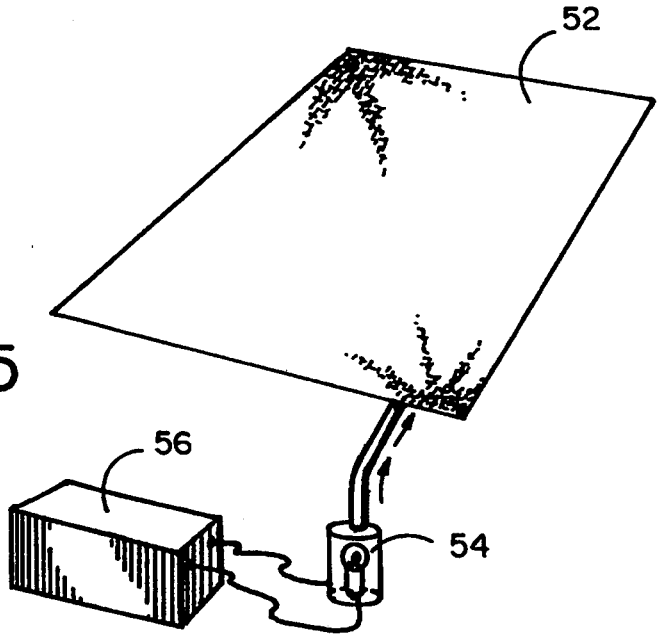
FIG. 5 illustrates a perspective view of a luminescent woven fiber-optic fabric illuminated by a battery-operated.

FIG. 1 illustrates a perspective view of book 10 having page 12 with printing 22 thereon to be read. Between page 12 and page 16 thereunder is disposed electroluminescent sheet 14. An equivalent luminous woven fiber-optic fabric 52, such as seen in FIG. 5, can also be utilized. Electroluminescent sheet 14 can be stiff for ease in handling and can be attached temporarily or permanently by electrical wires 18 to battery pack 20 or other power source on the exterior of the book cover, incorporated into the book's spine or attached to an electrical power source by equivalent means. Battery pack 50, as seen in FIG. 4, can also be clipped onto a belt around the user's waist and connected by flexible electrical leads. Luminescent sheet 34 can also be fitted with a flat, rechargeable battery pack 46, as seen in FIG. 3, activated by switch 48 which batteries are also well known in the prior art. When electroluminescent sheet 14, seen in FIG. 1, is electrically activated, it illuminates the imprinted sheet from below, thereby making printing 22 on imprinted page 12 visible. After reading printing 22 on page 12, one can remove the electroluminescent sheet 14 and place it under the next imprinted sheet or page to be read. Even in total darkness the light emanating from the electrically activated electroluminescent sheet passes through the imprinted page so as to make the printing thereon visible and readable. Although an imprinted page from a book is illustrated in FIG. 1, the device and method of this invention can be utilized to illuminate a single imprinted sheet.

Figure 2:
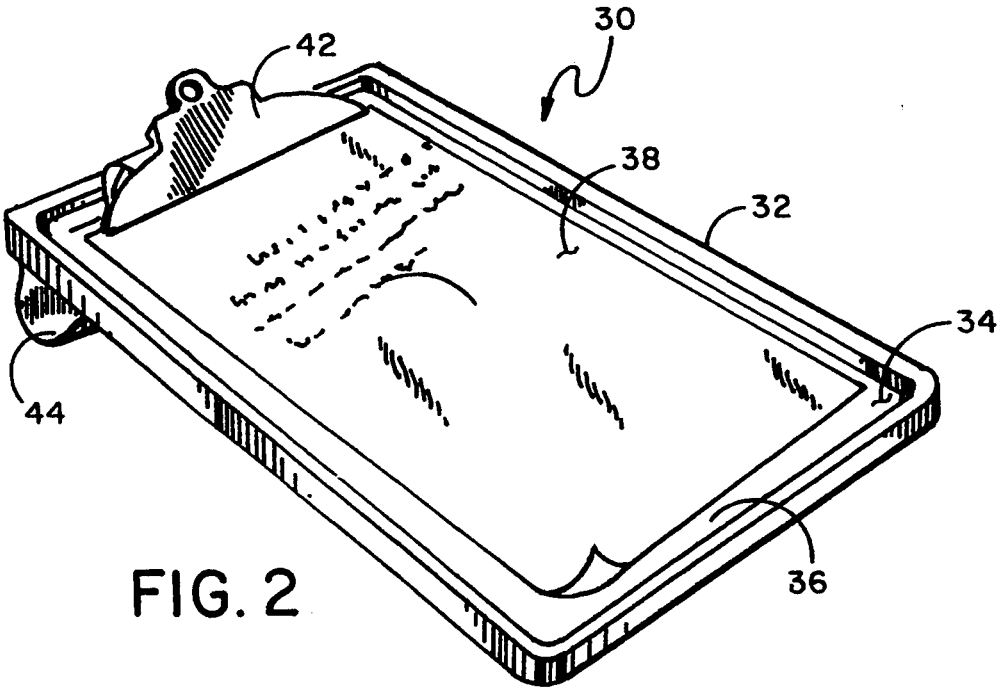
FIG. 2 illustrates a perspective view of a clipboard having a luminescent sheet disposed in a recess on the clipboard's top surface with a sheet having printed indicia thereon placed on top of the luminescent sheet.

In the same manner a single sheet 38, as seen in FIG. 2, can be positioned on clipboard 30 having recess 36 defined in its top surface. Electroluminescent sheet 34 is placed in the recess and can receive electrical current from a power source such as battery pack 44 incorporated as part of the clipboard. Recess 36 with electroluminescent sheet 34 disposed therein occupies almost the entire top surface of the clipboard, leaving a narrow edge band 32 around the clipboards perimeter to help retain the electroluminescent sheet in place. When imprinted sheet 38 is positioned in recess 36 under clip 42 and electrical power illuminates electroluminescent sheet 34, printing 40 becomes visible on imprinted sheet 38 and can then be read even in the dark or in a dimly lit environment. One can also write on an illuminated sheet on, for example, a clipboard and light 49 denoted by the arrows which passes therethrough, as seen in FIG. 3, will allow the writer to see what he or she is writing. When a luminous woven fiber-optic fabric is used, a light source 54 powered by battery 56, as seen in FIG. 5, is needed for light to be produced which light is then directed into the continuous fiber-optic weave to cause illumination of the sheet's surface. A transparent or translucent cover sheet can be placed over such fiber-optic woven fabric to protect it from wear and to provide a uniform; planar writing surface. Further, a cover sheet having a particular color, such as red, can be placed over the luminescent sheet to impart the cover sheet's color to the light produced.

Although the present invention has been described with reference to particular embodiments, it will be apparent to those skilled in the art that variations and modifications can be substituted therefor without departing from the principles and spirit of the invention.

I claim:

1. An illumination device for enabling an individual to read and/or write on a sheet under poor or no light conditions, said sheet having a top surface and a bottom surface, comprising:

an electroluminescent sheet;

means to illuminate said electroluminescent sheet, said electroluminescent sheet of a size to be disposed under said sheet to be read/written on, said illuminated electroluminescent sheet passing light through said sheet to make any printing or writing thereon visible to said individual;

an electrical power source and means to interconnect said power source to said electroluminescent sheet;

a clipboard having a top surface, said electroluminescent sheet disposed on said clipboard's top surface with said sheet to be read/written positioned on top of said electroluminescent sheet such that when said electrical power source illuminates said electroluminescent sheet, the light from said electroluminescent sheet passes through said sheet, making the printing/writing thereon visible to said individual; and a recess defined in said top surface of said clipboard of a size to receive and retain said electroluminescent sheet.

2. The device of claim 1 wherein said electrical power source is incorporated within said clipboard.

3. The device of claim 2 wherein said electrical power source is a flat battery pack.

4. The device of claim 1 wherein said electroluminescent sheet produces red light.

5. An illumination device for enabling an individual to read and/or write on A sheet under poor or no light conditions, said sheet having a top surface and a bottom surface, comprising:

a luminescent sheet;

means to illuminate said luminescent sheet, said luminescent sheet of a size to be disposed under said sheet to be read/written on, said illuminated luminescent sheet passing light through said sheet to make any printing or writing thereon visible to said individual;

wherein said luminescent sheet comprises a sheet of woven fiber-optic fabric and said device further includes an electrical power source, a light source activated by said electrical power source and means to direct said light source into said woven fiber-optic fabric;

further including a clipboard having a top surface, said luminescent sheet disposed on said clipboard's top surface with said sheet to be read/written on positioned on top of said luminescent sheet such that when said electrical power source illuminates said light source to illuminate said luminescent sheet, the light from said luminescent sheet passes through said sheet, making the printing/writing thereon visible to said individual; and further including a recess defined in said top surface of said clipboard of a size to receive and retain said luminescent sheet.

6. The device of claim 5 wherein said light source is incorporated within said clipboard.

7. The device of claim 5 wherein said luminescent sheet produces red light.

* * * * *